US008056680B2

(12) United States Patent
Broten

(10) Patent No.: US 8,056,680 B2
(45) Date of Patent: Nov. 15, 2011

(54) WEARABLE, SELF-DEPLOYING FALL ARREST DEVICE

(76) Inventor: Neil E. Broten, Ellicott City, MD (US)

( * ) Notice: Subject to any disclaimer, the term of this patent is extended or adjusted under 35 U.S.C. 154(b) by 480 days.

(21) Appl. No.: 12/399,495

(22) Filed: Mar. 6, 2009

(65) Prior Publication Data

US 2010/0224443 A1 Sep. 9, 2010

(51) Int. Cl.
*A63B 27/00* (2006.01)
*B25B 27/00* (2006.01)

(52) U.S. Cl. ..... 182/221; 81/488

(58) Field of Classification Search ..... 182/221; 294/25; 24/376, 371, 373, 592.1; 81/488
See application file for complete search history.

(56) References Cited

U.S. PATENT DOCUMENTS

| | | | | | |
|---|---|---|---|---|---|
| 758,196 | A | | 4/1904 | Thomas | |
| 1,274,481 | A | | 8/1918 | West | |
| 1,346,894 | A | | 7/1920 | Jacobs | |
| 2,278,610 | A | | 4/1942 | Brownson et al. | |
| 2,484,181 | A | * | 10/1949 | Munger et al. | 182/221 |
| 2,484,389 | A | * | 10/1949 | Schatz | 36/7.6 |
| 3,752,524 | A | * | 8/1973 | Reick, Jr. | 294/25 |
| 3,981,526 | A | | 9/1976 | Lundqvist | |
| 4,622,707 | A | | 11/1986 | Finn | |
| 5,082,292 | A | | 1/1992 | Puckett et al. | |
| 5,100,143 | A | | 3/1992 | Puckett | |
| 5,231,775 | A | * | 8/1993 | Trent, Jr. | 36/113 |
| 5,325,596 | A | | 7/1994 | Baker | |
| D388,243 | S | * | 12/1997 | Lupo | D2/963 |
| 5,768,727 | A | | 6/1998 | Brainerd | |
| 5,853,067 | A | * | 12/1998 | Cutler | 182/221 |
| 5,924,752 | A | * | 7/1999 | Moody | 294/25 |
| 6,122,770 | A | | 9/2000 | Mathison et al. | |
| 6,148,959 | A | * | 11/2000 | Shay | 182/221 |
| 6,244,639 | B1 | | 6/2001 | Storck | |
| 6,743,128 | B2 | | 6/2004 | Liechty, II | |
| 6,845,846 | B1 | * | 1/2005 | Gragnano | 182/134 |
| 7,114,222 | B2 | * | 10/2006 | Lemire et al. | 24/370 |
| 2001/0054526 | A1 | * | 12/2001 | Haltom | 182/221 |
| 2005/0108862 | A1 | * | 5/2005 | Lemire et al. | 24/592.1 |
| 2007/0193036 | A1 | | 8/2007 | Carlson | |

FOREIGN PATENT DOCUMENTS

DE 3442933 5/1986

(Continued)

OTHER PUBLICATIONS http://nicnac.net/ Switchblade Knives Automatic Knife S . . . accessed Sep. 11, 2008, 1 page.

(Continued)

*Primary Examiner* — Katherine Mitchell
*Assistant Examiner* — Jaime F Cardenas-Garcia
(74) *Attorney, Agent, or Firm* — Thorpe North & Western LLP

(57) ABSTRACT

A wearable, self-deploying fall arrest device to resist sliding movement of a climber on a climbing surface includes a pick blade pivotable between a retracted position and a deployed position. A tip of an out-turned tooth on the pick blade can be oriented downwardly and outwardly in the retracted position to engage and catch the climbing surface. An out-turned fin can be disposed on the opposite end of the pick blade above the pivot to urge the pick blade out of the retracted position upon pressing the fin against the climbing surface.

20 Claims, 5 Drawing Sheets

FOREIGN PATENT DOCUMENTS

DE 29822841 12/1998

OTHER PUBLICATIONS http://www.impaactguns.com/store/be . . . Benchmade Automatic Knives, accessed Sep. 11, 2008, 3 pages.

http://www.familydefense.com/auto1 . . . , Family Defense Products Home Security, Surveillance and Self Defense Products, accessed Sep. 11, 2008, 3 pages.

http://farm1.static.flickr.com/234/550 . . . Batman's New Suite, accessed Sep. 11, 2008, 2 pages.

* cited by examiner

WEARABLE, SELF-DEPLOYING FALL ARREST DEVICE

BACKGROUND

1. Field of the Invention

The present invention relates generally to a fall arrest device to assist a snow, rock, ice or mountain climber or the like during a slide or fall.

2. Related Art

Climbing is a popular outdoor activity in which a climber traverses various different terrains, including snow, rocks, ice, etc. Various different types of equipment can be utilized to assist the climber, including crampons, ice axes, etc. It will be appreciated that climbing can be dangerous and that a climber can lose footing or grip and slide or fall. For example, the climber's boot may come out of the crampon, or a climber's grip may come loose from an ice axe.

SUMMARY OF THE INVENTION

It has been recognized that it would be advantageous to develop a device to assist climbers in climbing and maintaining a grip or hold on the terrain. In addition, it has been recognized that it would be advantageous to develop a device to assist climber during an accidental fall or slide. Furthermore, it has been recognized that it would be advantageous to develop a fall arrest device that is capable of self-deploying.

The invention provides a wearable, self-deploying fall arrest device configured to resist sliding movement of a climber on a climbing surface. The device includes a rigid base plate sized and shaped to conform to a limb or a torso of a climber's body, and means for securing the base plate to the limb or the torso of the climber's body. A pick blade is pivotally coupled to the base plate at a pivot near a proximal end of the pick blade. The pick blade is pivotable between: 1) a retracted position with the pick blade disposed adjacent the base plate, and 2) a deployed position with the pick blade extending outwardly and transversely with respect to the base plate.

In accordance with one aspect of the present invention, the device can include at least one out-turned tooth on a distal end of the pick blade. A tip of the tooth can be oriented outwardly with respect to the pivot in the retracted position. The out-turned tooth can engage and catch the climbing surface upon downward movement of the tooth against the climbing surface and urge the pick blade towards the deployed position. In accordance with another aspect of the present invention, an outer surface of the tooth can be oriented downwardly and outwardly with respect to the pivot in the retracted position. The outer surface can abut and slide along the climbing surface upon upward movement of the tooth against the climbing surface.

In accordance with another aspect of the present invention, the device can include an out-turned fin disposed on the proximal end of the pick blade and extending outwardly beyond an outer surface of the pick blade in the retracted position. The out-turned fin can urge the pick blade out of the retracted position upon pressing the fin against the climbing surface.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
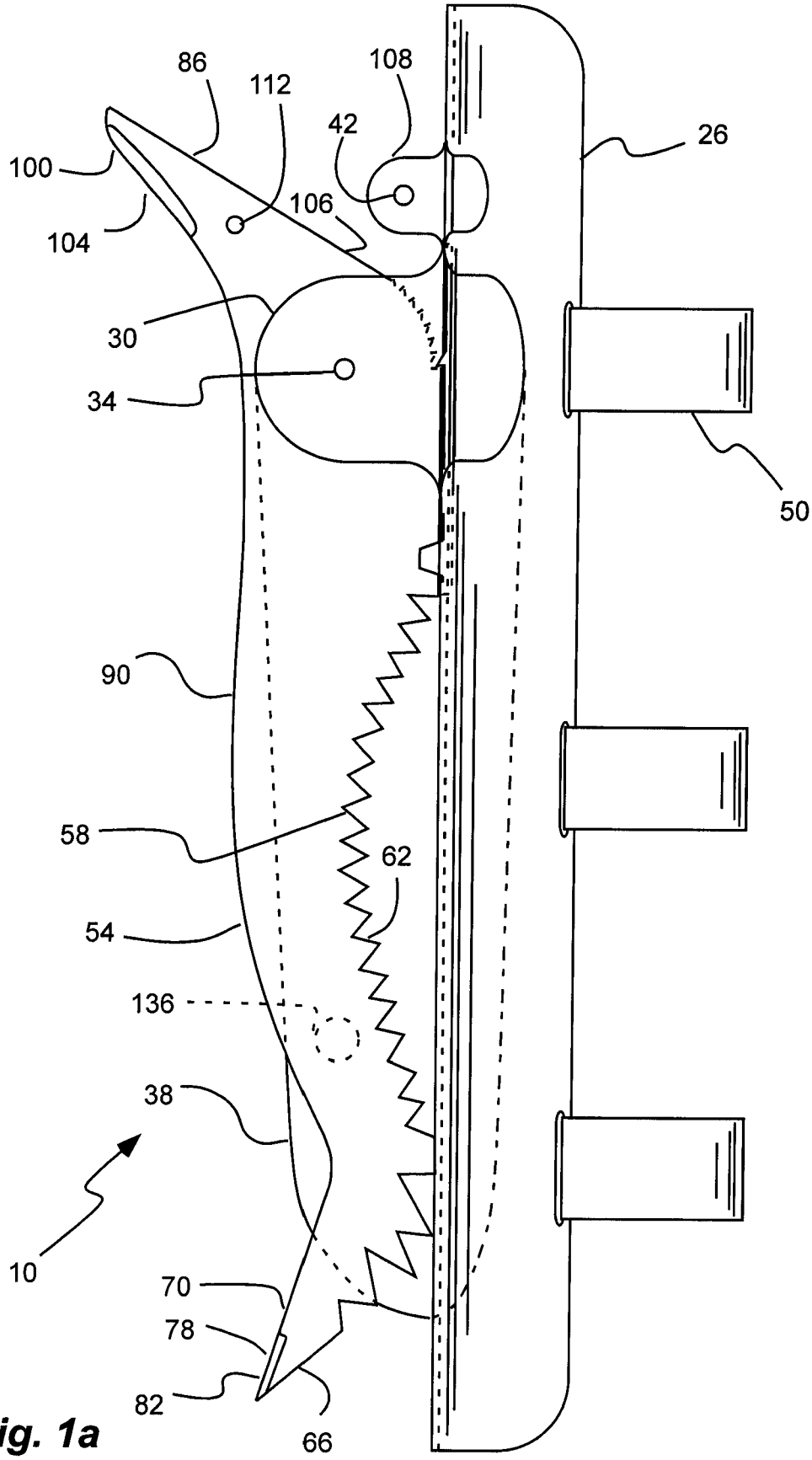
FIG. 1*a* is a side view of a wearable, self-deploying fall arrest device in accordance with an embodiment of the present invention shown in a retracted position, and with a portion of an optional sheath removed for clarity.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1*a*-3*c*, a wearable, self-deploying fall arrest device, indicated generally at 10, in an example implementation in accordance with the invention is shown. The fall arrest device 10 can be worn by a climber, such as on a climber's shin or lower leg 14, as shown in FIGS. 2*a-e*. It will be appreciated that the device can be worn anywhere on the climber's body including the legs, arms or torso. The fall arrest device 10 can resist sliding movement (indicated by arrow 18 in FIGS. 2*a-d*) of a climber on a climbing surface 22. The term "climbing surface" is used broadly herein as the terrain on which the climber is climbing, including for example, snow, ice, rock, dirt, a cliff surface, etc., and at any incline, including cliffs or slopes.

The fall arrest device 10 includes a base plate 26 sized and shaped to conform to a limb or a torso of a climber's body. For example, the base plate 26 can be curved, such as an elongated semi-cylindrical shell, to match the climber's body. In addition, the base plate 26 can be elongated and rigid to provide support. One or more flanges 30, such as the pair of flanges shown, can extend from the base plate to provide a pivot 34. The flanges 30 can narrow and disposed about a pivot, or can be wide and extend to form a sheath. Alternatively, one or more sides 38 of a sheath can extend from the base plate forming a slot therebetween. Similarly, one or more tabs 42 can extend from the base plate. The base plate can be formed of metal, such as steel or aluminum, and can be punched and stamped into the desired size and shape. The flanges 30, tabs 42, and/or sides 38 of the sheath can be portions of metal of the base plate cut and bent to extend from the base plate. Alternatively, the flanges 30, tabs 42, and/or sides 38 of the sheath can be attached to the base plate by welding, riveting and the like. Alternatively, the base plate, and the flanges 30, tabs 42, and/or sides 38 of the sheath, can be formed of composite material, such as graphite in a resin matrix, with the graphite fibers or cloth oriented for the appropriate strength and molded to the desired shape. A cushion member 46 (FIG. 1*c*), such as foam, can be disposed on the inner surface or inside of the base plate for comfort and to conform to uneven contours of the climber's body.

One or more straps 50 can be coupled to opposite sides of the base plate so that the straps 50 and base plate 26 together extend around the climber's body or limb. The straps can extend through apertures in the base plate, and can couple together or fasten with fasteners (not shown) such as buckles, clips, hook-and-loop type fasteners or the like, as is known in the art. The straps can be formed of webbing, cable, wire or the like. The straps are one example of means for securing the base plate to the limb or the torso of the climber's body. Other examples of means for securing can include for example bindings, clasps, etc. Another example of means for securing can include integrating the base plate into the climber's clothing, such as by sewing, etc.

Figure 1B:
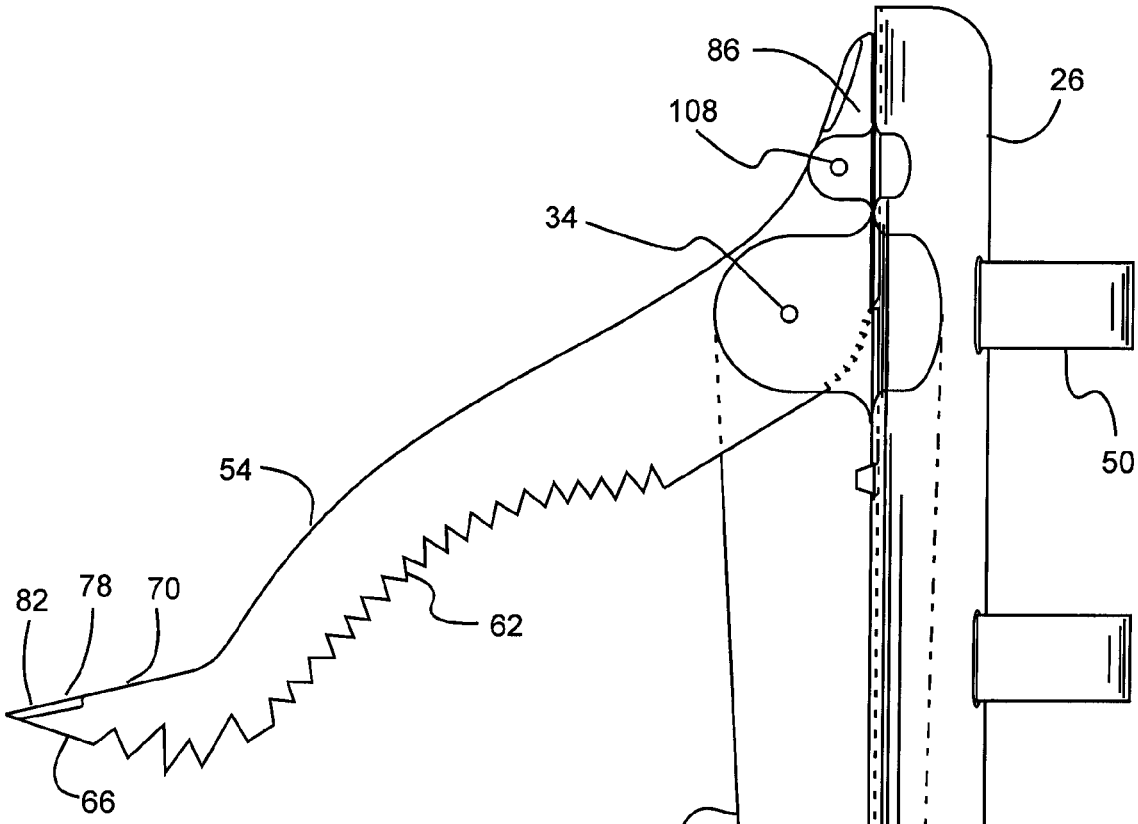
FIG. 1*b* is a side view of the wearable, self-deploying fall arrest device of FIG. 1*a* shown in a deployed position, and with a portion of an optional sheath removed for clarity.
Figure 1C:
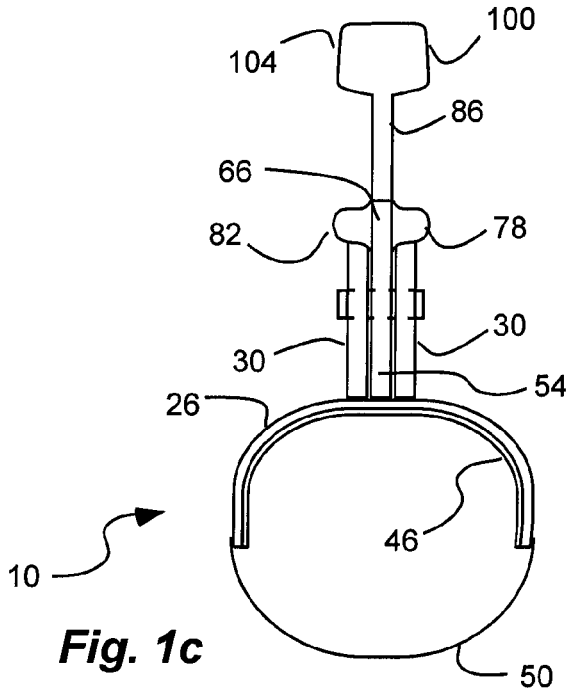
FIG. 1*c* is an end view of the wearable, self-deploying fall arrest device of FIG. 1*a* shown in the retracted position.

A pick blade 54 is pivotally coupled to the base plate 26 at a pivot 34. The pivot can include a pin, rivet, bolt or the like extending through apertures in the flanges 30. Thus, the pick blade can be held between the flanges 30 and secured with a rivet or the like that also forms the pivot. The pick blade can be elongated with an upper proximal end secured to the pivot, and a lower distal end opposite the proximal end and movable as the pick blade pivots. The pick blade pivots between: 1) a retracted position, as shown in FIG. 1*a*, with the pick blade extending downwardly and disposed adjacent the base plate, and 2) a deployed position, as shown in FIG. 1*b*, with the pick blade extending outwardly and transversely with respect to the base plate. The pick blade can be flat with an inner and lower blade surface or edge 58 that can include a plurality of teeth 62. Alternatively, the blade surface can be blunt. In addition, the pick blade can form an arc generally between the pivot and the distal end, and oriented concave facing inwardly with respect to the base plate in the retracted position. The size or length of the pick blade can be determined by the type of climbing surface. For example, shorter pick blades can be used for hard surfaces, such as rock or ice; while longer pick blades can be used for softer surfaces, such as snow, gravel or dirt.

Figure 2A:
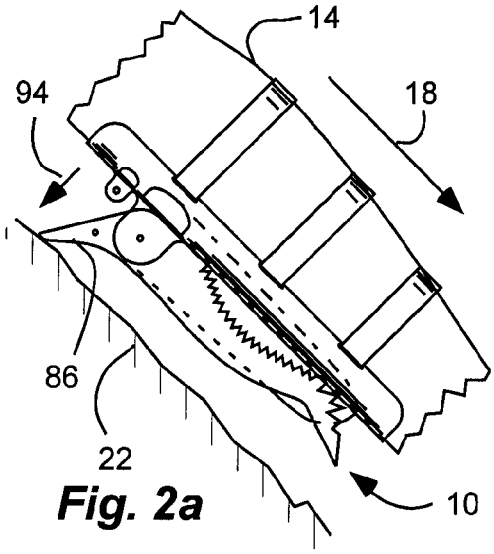
FIGS. 2*a-e* are side views of the wearable, self-deploying fall arrest device of FIG. 1*a* shown in operation in various different positions.
Figure 2D:
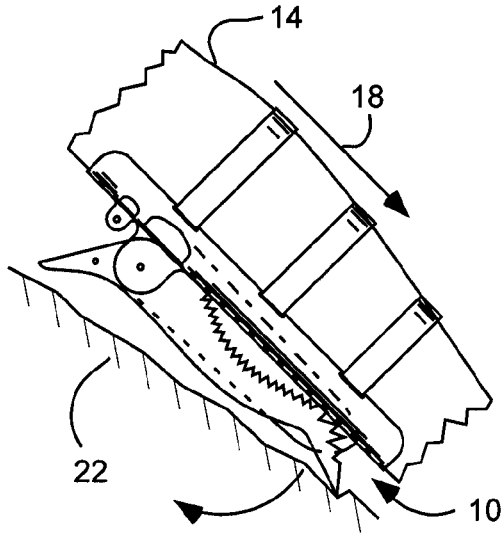
Figure 2B:
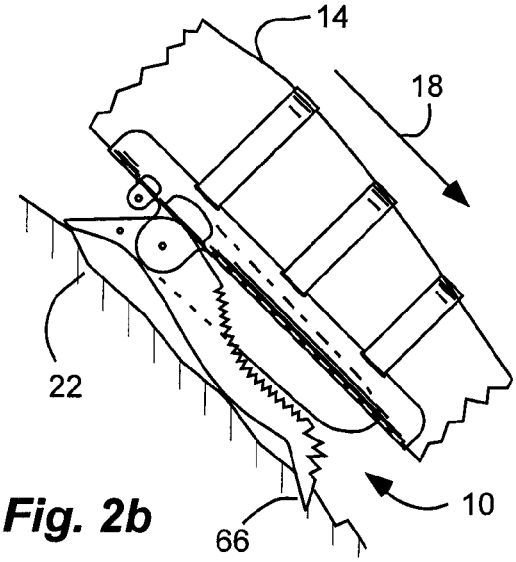
Figure 2E:
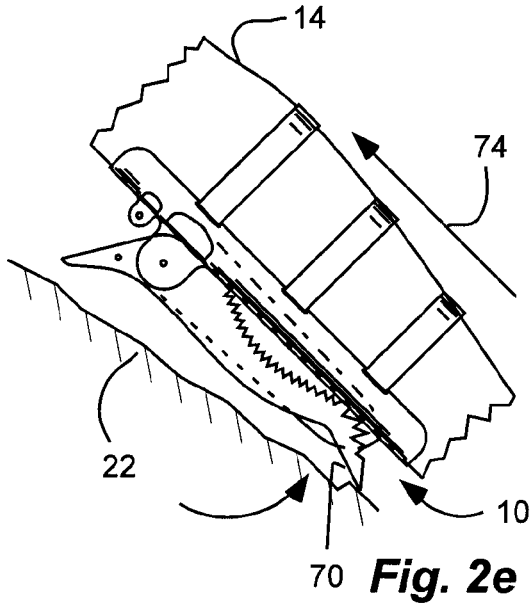
Figure 2C:
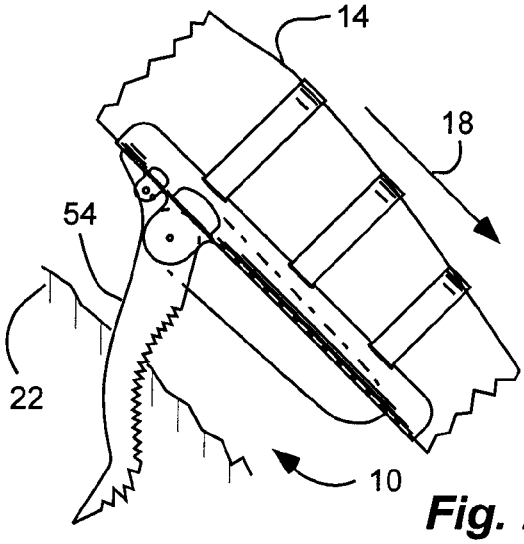
Figure 3A:
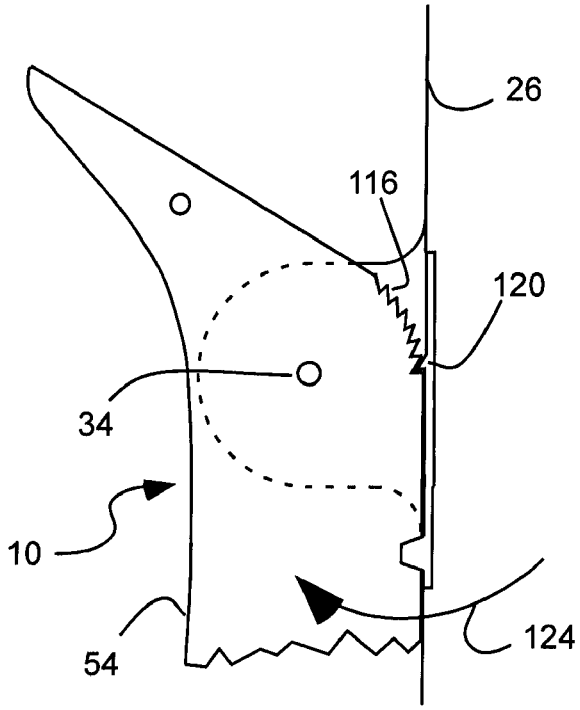
FIGS. 3*a-c* are partial side views of the wearable, self-deploying fall arrest device of FIG. 1*a* shown in operation in various different positions.
Figure 3B:
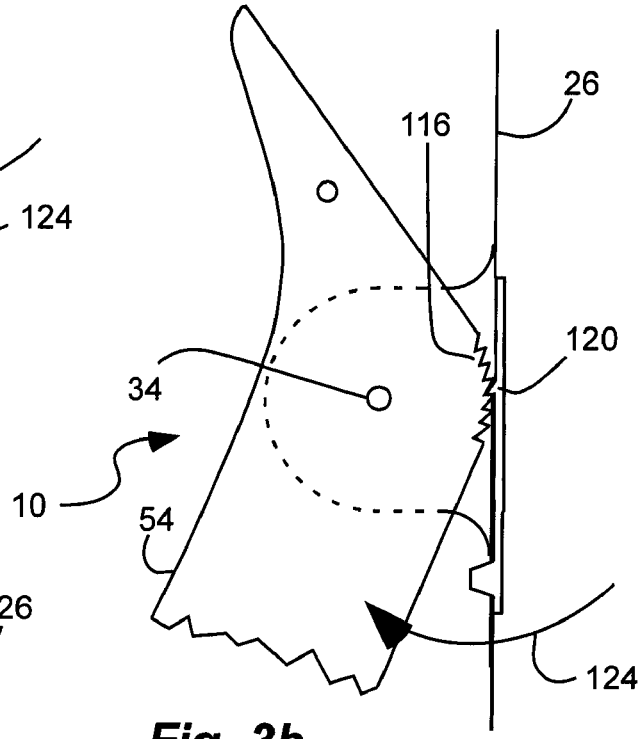
Figure 3C:
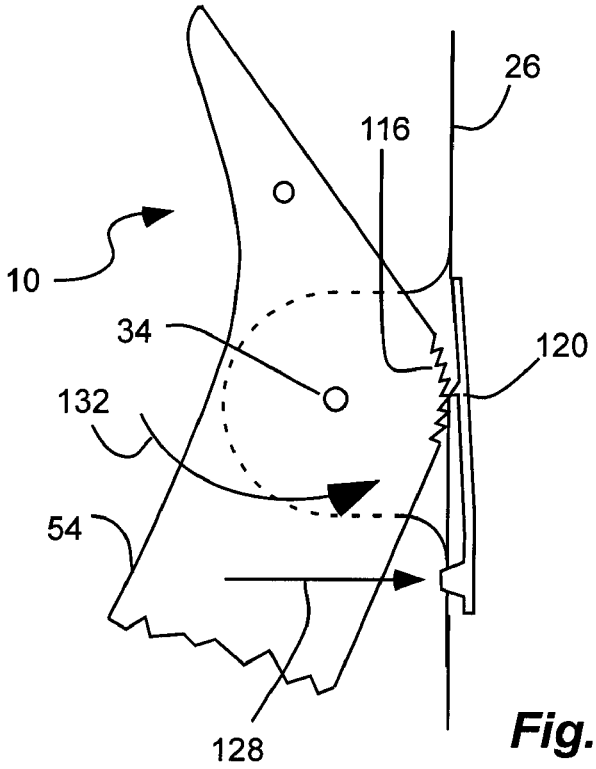

In accordance with one aspect of the present invention, the pick blade can include at least one out-turned tooth 66 on the distal end. The tooth can be formed in the plane or layer of the pick blade, but extend outwardly with respect to the base plate or sheath when the pick blade is in the retracted position. Thus, a tip of the tooth is oriented downwardly and outwardly with respect to the base plate in the retracted position. The tip of the tooth is disposed out of the sheath with the pick blade in the retracted position. Referring to FIG. 2*b* or 2*d*, the tip or tooth can engage and catch the climbing surface upon downward movement 18 of the tooth against the climbing surface 22, and urges the pick blade towards the deployed position. An outer surface 70 of the tooth can be oriented downwardly and outwardly with respect to the base plate in the retracted position. Referring to FIG. 2*e*, the outer surface 70 abuts and slides along the climbing surface 22 upon upward movement 74 of the tooth against the climbing surface. Therefore, as the climber climbs upwardly, the outer surface 70 can slide when it comes into contact with the climbing surface, and maintain the pick blade in the retracted position. But upon downward movement of the climber, the out-turned tooth 66 can engage the climbing surface, such as by catching on a contour or digging into the surface, and causing the pick blade to deploy to the deployed position to further engage and/or penetrate the surface to resist further downward movement.

In addition, the pick blade or out-turned tooth can have a broad head 78 disposed on the out-turned tooth 66 and that extends transversely with respect to the plane or layer of the pick blade 54. The broad head 78 can include one or more tabs 82 that can be orthogonal to the pick blade. The broad head or tabs can form a shovel or spade-like end on the pick blade to help it engage and/or penetrate the climbing surface. It will be appreciated that the broad head 78 of the out-turned tooth 66 can provide greater resistance to moving through the climbing surface than just the pick blade itself because the head is broader or wider than the pick blade. An outer surface of the broad head can also form part of the outer surface 70 of the out-turned tooth. The broad head or tabs can be formed of the same material as the pick blade, and may be formed by bending a portion of the pick blade, or welding the tab to the pick blade, or otherwise fastening the tab to the pick blade.

In accordance with another aspect of the present invention, the pick blade can include an out-turned fin 86 disposed on the proximal end of the pick blade above the pivot. Thus, the out-turned fin 86 and the out-turned tooth 66 are on an opposite ends of the pick blade, and on opposite sides of the pivot 34. The fin 86 can extend outwardly beyond an outer surface 90 of the pick blade in the retracted position. Referring to FIG. 2*a*, the fin 86 can be capable of urging the pick blade 54 out of the retracted position upon pressing the fin against the climbing surface 22, indicated by arrow 94. Thus, it will be appreciated that if the climber were to slip or fall, movement 94 of the climber's body 14 towards the climbing surface 22 causes the fin 86, which extends beyond the outer surface 90 of the pick blade in the retracted position, to contact the climbing surface, and urge the pick blade more into the deployed position. Urging the pick blade into the deployed position can assist the out-turned tooth 66 to better engage and/or penetrate the climbing surface 66, as shown in FIG. 2*b*. Further falling movement 18 of the climber's body 14 can also cause the out-turned tooth 66 to further pivot towards the deployed position, and to further penetrate the climbing surface, as in FIG. 2*c*.

In addition, the out-turned fin 86 can include a broad tab 100 disposed on the out-turned fin 86 that extends transversely with respect to the pick blade 54. The broad tab 100 can include one or more tabs 104 that can be orthogonal to the pick blade. The broad tab can form a broad surface that can abut to the climbing surface. It will appreciated that the broad tab can resist penetration into the climbing surface because it is broader than the pick blade. The broad tab can be formed of the same material as the pick blade, and may be formed by bending a portion of the pick blade, or welding the tab to the pick blade, or otherwise fastening the tab to the pick blade.

Furthermore, an inner portion 106 of the fin or pick blade above the pivot can abut to the base plate 26 in the deployed position to limit or stop over pivoting of the pick blade, as shown in FIG. 1*b*.

Although the fall arrest device 10 described and shown herein can include both the out-turned tooth 66 and the out-turned fin 86; it will be appreciated that the fall arrest device can be provide with only one or the other, such as only the tooth 66 or only the fin 86.

The fall arrest device can include a detent or detent mechanism 108 that can be coupled between the pick blade 54 and the base plate 26. The detent can be movable to engage between the pick blade and the base plate in the deployed position. For example, the detent 108 can be disposed on the base plate 26, or tab 42 thereof, and receivable in an aperture 112 on the pick blade 54 when the pick blade is in the deployed position (FIG. 1*b*). The detent can be biased or spring biased into the aperture so that the pick blade locks with respect to the base plate 26 in the deployed position. Locking the pick blade resists the pick blade from inadvertently moving out of the deployed position. The detent can be selectively movable to disengage to return the pick blade to the retracted position, such as by pushing or pulling the detent from the aperture 112. The detent or detent mechanism described above is one example of locking means for automatically locking the pick blade in the deployed position. It will be appreciated that other examples of locking means can include a plurality of lockable positions, the detent carried by the pick blade 54 (as opposed to being carried by the base plate), and the aperture being disposed on the base plate, the detent including a tooth or pawl engagable with a plurality of inclined teeth, etc.

In addition, the fall arrest device can be lockable at a plurality of intermediate positions between the retracted position and the deployed position to resist the pick blade from partially deploying and then inadvertently retracting. For example, referring to FIGS. 3*a-c*, a toothed wheel 116, or partial toothed wheel, can be disposed on, coupled to, or formed in the pick blade 54. The toothed wheel can be disposed between the pick blade and the base plate as shown, and can have a common pivot axis with the pivot axis 34 of the pick blade. A pawl 120 can be coupled to the base plate and can engage the toothed wheel 116. Thus, the pawl can be disposed between the pick blade and the base plate. The pawl can include an inclined tooth, inclined opposite to an inclination of the teeth on the toothed wheel. The teeth of the toothed wheel and the tooth of the pawl can be oriented such that the inclined side of the tooth of the pawl can move along the inclined side of the teeth of the toothed wheel in a direction towards the deployed position, indicated by arrow 124; but a blunt side of the tooth of the pawl can engage a blunt side of a tooth of the toothed wheel in a direction towards the retracted position, to lock the pick blade or resist its return. The pawl can be selectively movable, indicated by arrow 128, to disengage from the toothed wheel to allow the return of the pick blade to the retracted position, indicated by arrow 132. The pawl 120 can include an elongated spring member with one end attached to the base plate and a free end to allow the pawl to bend away from the toothed wheel. The toothed wheel and pawl are an example of ratchet means for locking the pick blade against returning to the retracted position at a plurality of intermediate positions between the retracted position and the deployed position. In addition, the toothed wheel can lock the pick blade in the deployed position. It will be appreciated that other examples of ratchet means can include the pawl being carried by the pick blade and the toothed wheel being carried by the base plate; different configurations, orientations and locations of the pawl and toothed wheel, etc. In addition, the toothed wheel and pawl are an example of the locking means.

The fall arrest device can further include mechanisms to bias the pick blade into or out of the retracted position. For example, a magnet 136 can be carried by the base plate or sheath to resist movement of the pick blade from the retracted position, and resist inadvertent deployment of the pick blade. The magnet is one example of biasing means for biasing the pick blade to the retracted position. Alternatively, the magnet may be carried by the pick blade. In addition, springs can be used.

Figure 4A:
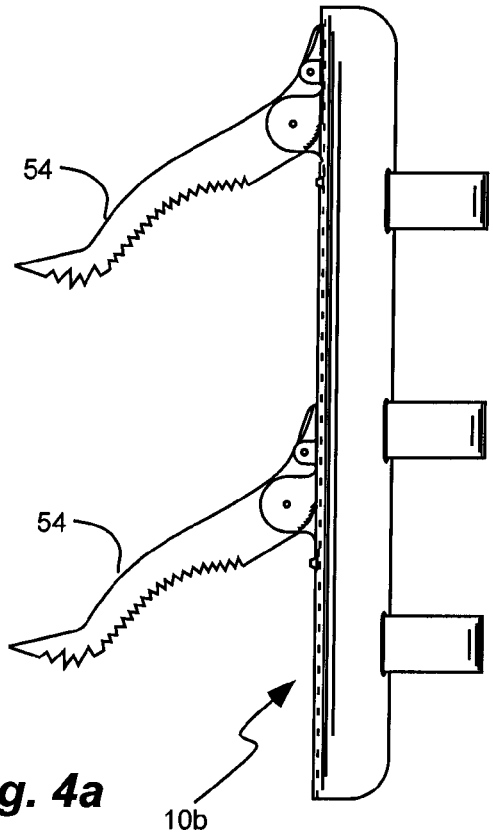
FIGS. 4*a* and 4*b* are side views of another wearable, self-deploying fall arrest device in accordance with another embodiment of the present invention shown in a deployed position.
Figure 4B:
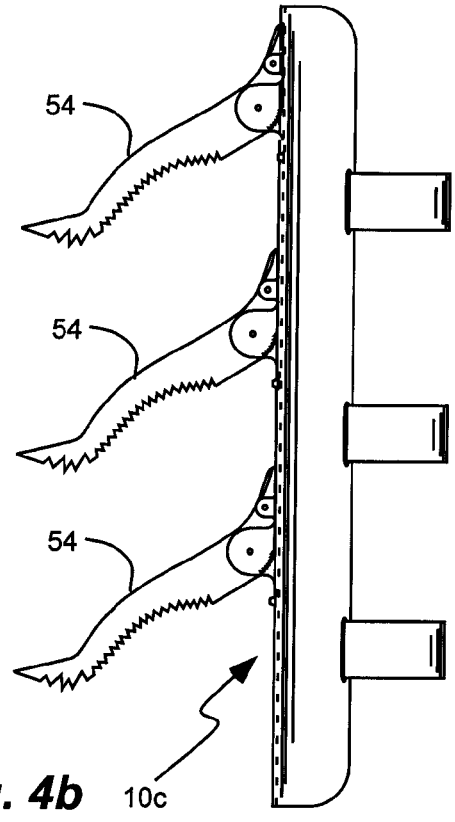
Figure 4C:
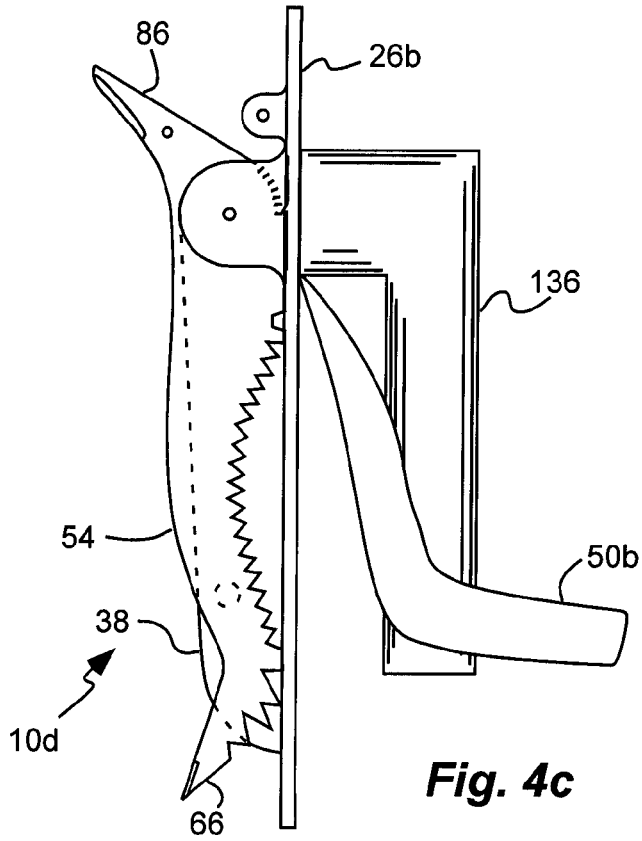
FIG. 4*c* is a side view of another wearable, self-deploying fall arrest device in accordance with another embodiment of the present invention shown in a retracted position.

Although the fall arrest device 10 has been described and shown herein as including a single pick blade, it will be appreciated that the fall arrest device can include a plurality of pick blades with different pivots, locations, and orientations. For example, referring to FIGS. 4*a* and 4*b*, fall arrest devices 10*b* and 10*c* can include two or three pick blades, respectively. It will be appreciated that the pick blades can be arrayed vertically, as shown, or off-set laterally.

Referring to FIG. 4*d*, another wearable fall arrest device 10*d* is shown that is configured to be worn on the climber's hand. The device 10*d* includes a handle 136 attached to the base plate 26*b*. A wrist strap 50*b* is attached to the handle 136 and/or base plate 26*b*. The wrist strap 50*b* can form a closed loop. In addition, the wrist strap can be adjustable in size. The wrist strap is another example of means for securing the base plate to the limb of the climber's body. In use the climber can grip the handle 136 with his or her hand with the wrist strap wrapped around his or her wrist.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A wearable, self-deploying fall arrest device configured to resist sliding movement of a climber on a climbing surface, comprising:

a) a rigid base plate sized and shaped to conform to a limb or a torso of a climber's body;

b) means for securing the base plate to the limb or the torso of the climber's body;

c) a pick blade pivotally coupled to the base plate at a pivot near a proximal end of the pick blade, and pivotable between a retracted position with the pick blade disposed adjacent the base plate, and a deployed position with the pick blade extending outwardly and transversely with respect to the base plate;

d) at least one out-turned tooth on a distal end of the pick blade; and e) a tip of the tooth being oriented outwardly with respect to the base plate in the retracted position to engage and catch the climbing surface upon downward movement of the tooth against the climbing surface and urge the pick blade towards the deployed position.

2. A device in accordance with claim 1, further comprising:

an outer surface of the tooth being oriented downwardly and outwardly with respect to the pivot in the retracted position to abut and slide along the climbing surface upon upward movement of the tooth against the climbing surface.

3. A device in accordance with claim 1, further comprising:

a sheath coupled to or formed with the base plate including opposite sides with a slot therebetween; and the tip of the tooth disposed out of the sheath with the pick blade in the retracted position.

4. A device in accordance with claim 1, further comprising:

a broad head disposed on the out-turned tooth extending transversely with respect to the pick blade.

5. A device in accordance with claim 1, further comprising:

an out-turned fin disposed on the proximal end of the pick blade and extending outwardly beyond an outer surface of the pick blade in the retracted position and capable of urging the pick blade out of the retracted position upon pressing the fin against the climbing surface.

6. A device in accordance with claim 5, further comprising:

a broad tab disposed on the fin extending transversely with respect to the fin.

7. A device in accordance with claim 1, further comprising:

locking means for automatically locking the pick blade in the deployed position.

8. A device in accordance with claim 7, wherein the locking means comprises:

a detent coupled between the pick blade and the base plate and movable to engage between the pick blade and the base plate in the deployed position, and selectively movable to disengage to return the pick blade to the retracted position.

9. A device in accordance with claim 7, wherein the locking means further comprises:

ratchet means for locking the pick blade against returning to the retracted position at a plurality of intermediate positions between the retracted position and the deployed position.

10. A device in accordance with claim 9, wherein the ratchet means comprises:

a toothed wheel engageable by a pawl coupled between the pick blade and the base plate, the pawl movable along teeth of the toothed wheel in a direction towards the deployed position, but engaging a tooth of the toothed wheel in a direction towards the retracted position, the pawl selectively movable to disengage to return the pick blade to the retracted position.

11. A device in accordance with claim 1, further comprising:

biasing means for biasing the pick blade to the retracted position.

12. A wearable, self-deploying fall arrest device configured to resist sliding movement of a climber on a climbing surface, comprising:

a) a rigid base plate sized and shaped to conform to a limb or a torso of a climber's body;

b) means for securing the base plate to the limb or the torso of the climber's body;

c) a pick blade pivotally coupled to the base plate at a pivot near a proximal end of the pick blade, and pivotable between a retracted position with the pick blade disposed adjacent the base plate, and a deployed position with the pick blade extending outwardly and transversely with respect to the base plate; and d) an out-turned fin disposed on the proximal end of the pick blade and extending outwardly beyond an outer surface of the pick blade in the retracted position and capable of urging the pick blade out of the retracted position upon pressing the fin against the climbing surface.

13. A device in accordance with claim 12, further comprising:

a broad tab disposed on the fin extending transversely with respect to the fin.

14. A device in accordance with claim 12, further comprising:

a) at least one out-turned tooth on a distal end of the pick blade;

b) a tip of the tooth being oriented outwardly with respect to the pivot in the retracted position to engage and catch the climbing surface upon downward movement of the tooth against the climbing surface and urge the pick blade towards the deployed position; and c) an outer surface of the tooth being oriented downwardly and outwardly with respect to the pivot in the retracted position to abut and slide along the climbing surface upon upward movement of the tooth against the climbing surface.

15. A device in accordance with claim 14, further comprising:

a broad head disposed on the out-turned tooth extending transversely with respect to the pick blade.

16. A device in accordance with claim 12, further comprising:

locking means for automatically locking the pick blade in the deployed position.

17. A device in accordance with claim 16, wherein the locking means comprises:

a detent coupled between the pick blade and the base plate and movable to engage between the pick blade and the base plate in the deployed position, and selectively movable to disengage to return the pick blade to the retracted position.

18. A device in accordance with claim 16, wherein the locking means further comprises:

ratchet means for locking the pick blade against returning to the retracted position at a plurality of intermediate positions between the retracted position and the deployed position.

19. A device in accordance with claim 18, wherein the ratchet means comprises:

a toothed wheel engageable by a pawl coupled between the pick blade and the base plate, the pawl movable along teeth of the toothed wheel in a direction towards the deployed position, but engaging a tooth of the toothed wheel in a direction towards the retracted position, the pawl selectively movable to disengage to return the pick blade to the retracted position.

20. A wearable, self-deploying fall arrest device configured to resist sliding movement of a climber on a climbing surface, comprising:

a) a rigid base plate sized and shaped to conform to a limb or a torso of a climber's body;

b) means for securing the base plate to the limb or the torso of the climber's body;

c) a pick blade pivotally coupled to the base plate at a pivot near a proximal end of the pick blade, and pivotable between a retracted position with the pick blade adjacent the base plate, and a deployed position with the pick blade extending outwardly and transversely with respect to the base plate;

d) an out-turned tooth on a distal end of the pick blade;

e) a tip of the tooth disposed out of the sheath in the retracted position;

f) the tip being oriented downwardly and outwardly with respect to the pivot in the retracted position to engage and catch the climbing surface upon downward movement of the tooth against the climbing surface and urge the pick blade towards the deployed position;

g) an outer surface of the tooth being oriented downwardly and outwardly with respect to the pivot in the retracted position to abut and slide along the climbing surface upon upward movement of the tooth against the climbing surface;

h) a broad head disposed on the out-turned tooth extending transversely with respect to the pick blade;

i) an out-turned fin disposed on the proximal end of the pick blade above the pivot and extending outwardly beyond an outer surface of the pick blade in the retracted position and capable of urging the pick blade out of the retracted position upon pressing the fin against the climbing surface;

j) a broad tab disposed on the fin extending transversely with respect to the fin; and k) locking means for automatically locking the pick blade in the deployed position.

* * * * *